US006742908B2

(12) United States Patent
Bland

(10) Patent No.: US 6,742,908 B2
(45) Date of Patent: Jun. 1, 2004

(54) LOFTY VISUAL WARNING DEVICES FOR WALKING SHOES

(76) Inventor: Todd A. Bland, 13708 Frederick Ave., Omaha, NE (US) 68138

( * ) Notice: Subject to any disclaimer, the term of this patent is extended or adjusted under 35 U.S.C. 154(b) by 68 days.

(21) Appl. No.: 09/766,410

(22) Filed: Jan. 22, 2001

(65) Prior Publication Data

US 2002/0097154 A1 Jul. 25, 2002

(51) Int. Cl.[7] ..... F21V 9/16

(52) U.S. Cl. ..... 362/84; 362/103; 362/806; 36/137; 250/462.1; 250/466.1

(58) Field of Search ..... 362/84, 103, 253, 362/806; 36/1, 136, 137; 250/462.1, 466.1; 340/321, 815.41, 815.42, 815.43, 815.44, 815.45, 815.46; D02/964, 968, 976; 2/245

(56) References Cited

U.S. PATENT DOCUMENTS

| | | | | | |
|---|---|---|---|---|---|
| 4,038,552 | A | * | 7/1977 | Ciofalo | 116/209 |
| 4,642,910 | A | * | 2/1987 | Carter et al. | 359/518 |
| 5,246,749 | A | * | 9/1993 | Handzlik | 2/245 |
| 5,473,518 | A | * | 12/1995 | Haber et al. | 36/137 |
| 6,412,197 | B1 | * | 7/2002 | Krull | 36/136 |

* cited by examiner

*Primary Examiner*—Stephen F. Husar
(74) *Attorney, Agent, or Firm*—George R. Nimmer, Attorney at Law

(57) ABSTRACT

For regularly encounterable walking shoes environments typically having a treaded lower-base and an overlying foot-rest surface, disclosed herein are visual warning devices respectively extending loftily vibratorily helically above the foot-rest surface and topically carrying a visually bright ornamental feature. The bright ornamental feature (preferably of bulbous shape) is alternatively provided as: of self-luminescent characteristic; or alternatively, as an electrically-powerable incandescent bulb powerable from a chemical storage-battery that is rearwardly removably attachable to the walking shoe environment.

5 Claims, 2 Drawing Sheets

LOFTY VISUAL WARNING DEVICES FOR WALKING SHOES

BACKGROUND OF THE INVENTION

Toward the quest of augmenting typically encounterable walking shoes with rearwardly positioned visually bright warning means, prior art workers have relegated their quest toward positioning the bright warning means to lowerably restricted positions at the walking shoe lower-base which is oftentimes obscurable to environmental traffic.

GENERAL OBJECTIVE OF THE INVENTION

To overcome the visually obscure utilitarian deficiencies associated with prior art workers' narrowly-positionably focused efforts to provide effectively warnable encounterability for wearers of typically worn walking shoes.

GENERAL STATEMENT OF THE INVENTION

With the above mentioned general objective in view, and together with other related and ancillary objectives, which will become more apparent as this description proceeds: the herein "lofty visual warning devices for walking shoes" of the present invention generally comprises: rearwardly attached to the walking shoe lower-base adjacent its rear-end and extending loftily therefrom even above the walking shoe foot-rest surface, one or more lofty visual warning devices respectively comprising a lofty and horizontally vibratory helical column and which respectively topically carry a visually bright ornamental feature, and the latter being selectively alternatively: as an electrically-powerably incandescent bulb from a chemical storage-battery that is removably attached to the walking shoe lower-base; or alternatively, as a self-phosporescent bulbous ornament not requiring external electrical power.

BRIEF DESCRIPTION OF THE DRAWING

In the drawing, wherein like characters refer to like parts in the several views, and in which.

Drawing

DETAILED DESCRIPTION OF THE DRAWING

Figure 1:
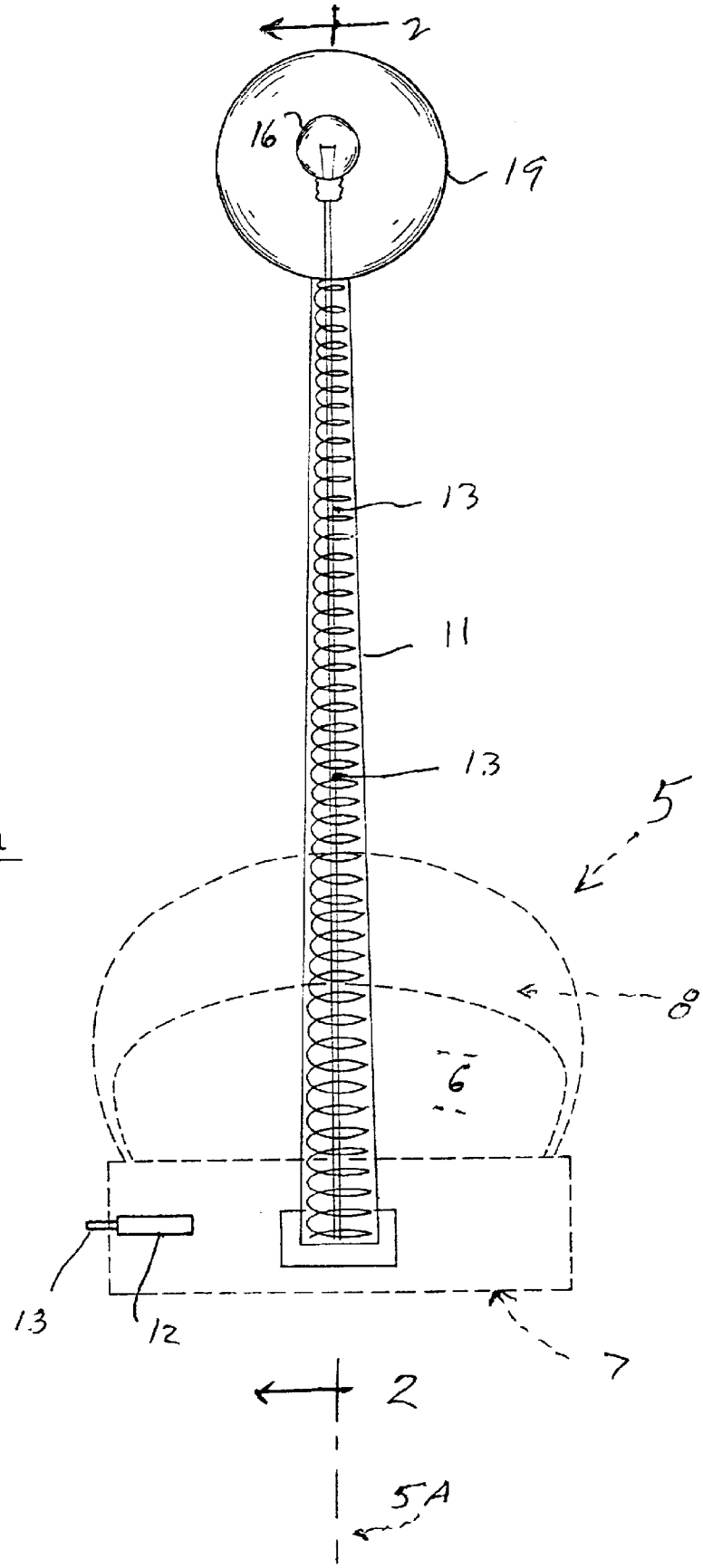
FIG. 1 is a rearward elevational view of a typically encounterable prior art walking shoe environment (5), herein environmentally depicted in phantom-lines, and as seen in solid lines, augmentally equipped with a representative embodiment (10) of the "lofty visual warning device concept" of the present invention; and Drawing
Figure 2:
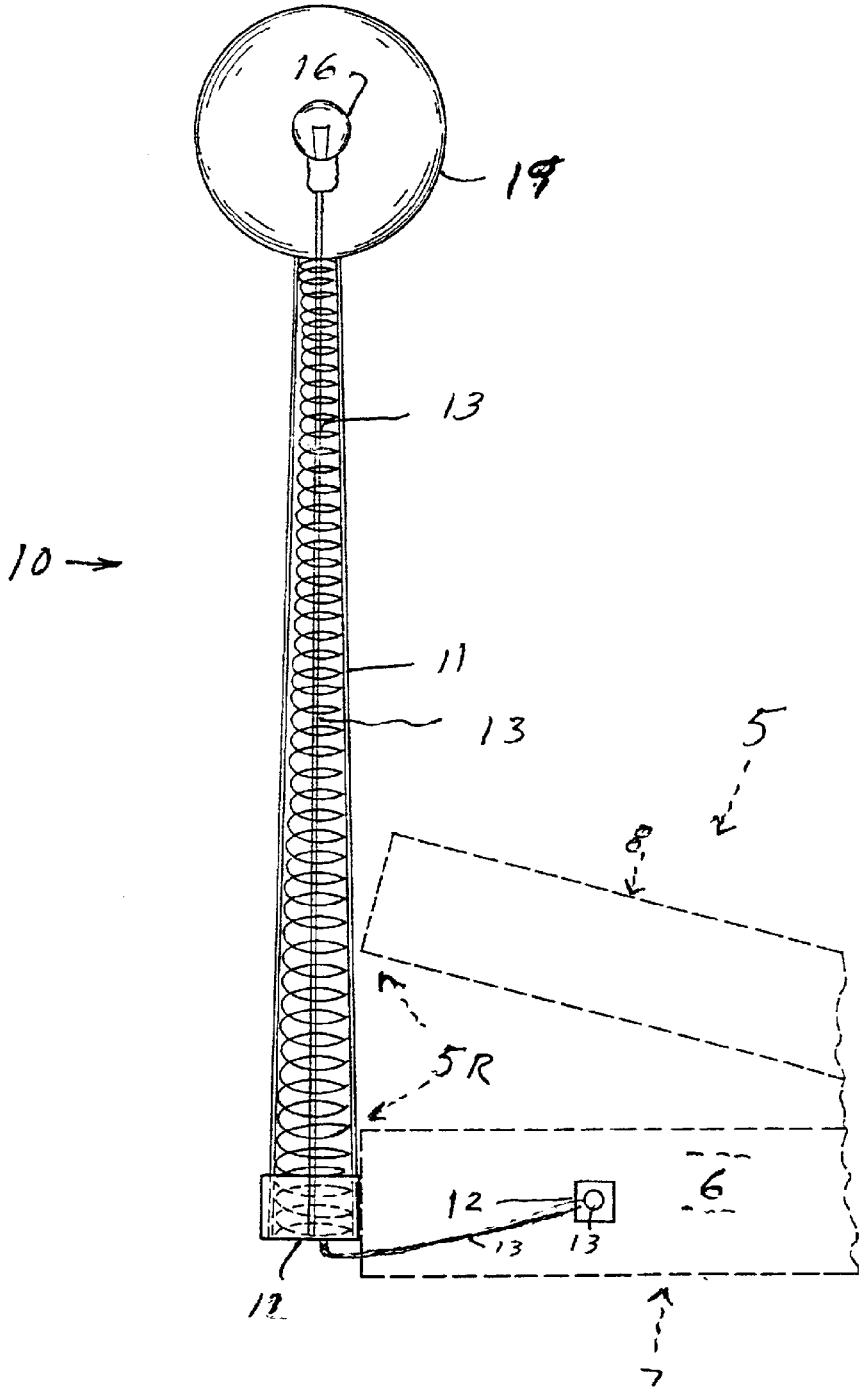
FIG. 2 is a sectional elevational view taken along line 2—2 of FIG. 1, and which section line 2—2 is synonymous with the prior art walking shoe (5) central upright-plane (5A).

As mentioned hereabove, phantom lines in drawing FIGS. 1 and 2 refer to a typical walking shoe environment (5) for the lofty warning devices concept of (e.g. 10) of the present invention. And for such typical walking shoes (e.g. 5), they typically extend directionally longitudinally forwardly from the walking shoe rear-end (5R) as a lower-base (6) having a lower-tread (7) and with a co-longitudinal foot-rest surface (8) thereabove.

The novel lofty warning devices (e.g. 10) for typical walking shoes (e.g. 5) essentially comprise one or more lofty and horizontally vibratory columns (Preferably of helical construction) that are respectively relegatively attached to the rear-end portion of the walking shoe lower-base (5) and extending loftily therefrom and even loftily above the walking shoe foot-rest surface (8). Each such lofty and springy upright column (e.g. 11) topically carries a visually, bright ornamental feature (e.g. 19). Such bright ornamental characteristic is alternatively provided by: some structurally inherent nature e.g. chemical phospherescence; or alternatively, a chemical storage battery (e.g. 12) having an electrically conductive stance with an incandescent bulb (e.g. 16) carried by the ornamental feature (19).

From the foregoing, the construction and operation of the "lofty visual warning devices for walking shoes" of the present invention will be readily understood and further explanation believed to be unnecessary. However, since numerous modifications and changes will readily occur to those skilled in the art: it is not desired to limit the invention to the exact construction shown and described, and accordingly, all suitable modifications and equivalents may be resorted to, zs as falling within the scope of the appended claims.

What is claimed is as follows:

1. For the environment of a typical walking shoe that extends directionally longitudinally along a central upright-plane and having a horizontal lower-base extending directionally longitudinally from a rear-end thereof, the improvement comprising: relegatively attachably confined to the rear-end of the walking shoe lower-base and extending loftily thereabove a visual warning means comprising: at least one lofty and horizontally vibratory upright column and wherein each such column topically carries a visually prominent bright ornamental feature.

2. The improved walking shoe of claim 1 wherein the at least one topically carried ornamental feature possesses a luminescent characteristic and wherein each such column is loftily helically provided throughout.

3. The structure of claim 2 wherein the at least one visually bright topical ornamental feature is itself independently luminescent and without the need of a chemical storage-battery.

4. For the environment of a typical walking, shoe that extends directionally horizontally longitudinally along a central upright-plane and having a horizontal lower-base extending directionally longitudinally from a walking shoe rear-end, an improved walking show comprising:

for the walking shoe lower-base at the rear-end thereof, means for attaching at least one lofty and horizontally vibratory upright column to the walking shoe;

in addition to a said at least one upright column, a visually prominent ornamental feature topically positioned thereat; and means for topically attaching a said prominent ornamental feature to said upright column.

5. The improved walking shoe of claim 4 wherein the at least one topically carried ornamental feature possesses a luminencent characteristic and wherein each such column is loftily helically provided throughout.

* * * * *